United States Patent [19]

Gamble

[11] Patent Number: 5,013,890

[45] Date of Patent: May 7, 1991

[54] IMMERSION HEATER AND METHOD OF MANUFACTURE

[75] Inventor: Bobby G. Gamble, Watertown, Tenn.

[73] Assignee: Emerson Electric Co., St. Louis, Mo.

[21] Appl. No.: 383,626

[22] Filed: Jul. 24, 1989

[51] Int. Cl.[5] ..... H05B 3/04; H05B 3/48; H05B 3/78

[52] U.S. Cl. ..... 392/497; 219/437; 219/523

[58] Field of Search ..... 219/335, 437, 306, 316, 219/318, 319, 320, 336, 523

[56] References Cited

U.S. PATENT DOCUMENTS 4,177,320 12/1979 Yoshimura et al. ..... 428/419

4,617,456 10/1986 Richards ..... 219/534

4,692,592 9/1987 Kale ..... 219/298

*Primary Examiner*—Roy N. Envall, Jr.

*Attorney, Agent, or Firm*—Polster, Polster and Lucchesi

[57] ABSTRACT

An immersion heater (1) for use in a chemically corrosive environment. An electrically conductive heating element (7) is immersible in the environment (C) and is capable of a watt-density of at least 30 watts per square inch when current flows through the element. A metallic sheath (9) covers the heating element. A coating (11) is applied over the sheath. The coating is capable of maintaining its coating properties not only when the heater is immersed in the environment, but also when the watt-density of the heating element exceeds 30 watts per square inch, and the temperature of the environment exceeds the boiling point of water.

5 Claims, 1 Drawing Sheet

IMMERSION HEATER AND METHOD OF MANUFACTURE

BACKGROUND OF THE INVENTION

This invention relates to immersion heaters and more particularly, to electrical immersion heaters for use in chemically corrosive environments and a method for manufacturing such heaters.

In certain manufacturing processes, it is necessary to heat a vat or tank of chemicals. One way this is done is to immerse an over-the-side electrical heater in the chemical, and circulate an electrical current through the heater's heating element. In many instances, the chemicals being heated are corrosive and as such, attack the heater. Consequently, heaters of this type have a sheath of protective material over their heating element and, in addition, some type of coating is applied over the sheath. Until now, there has been a persistent problem in finding an adequate coating which can withstand the rigors of both the environment in which immersion heaters are used and the operation of the heater, especially at higher watt-densities. One problem encountered with previous coatings, for example, is their tendency to have or form pin holes. This, of course, allows the chemicals to penetrate the coating and attack the sheath and ultimately the heating element. The result is either a failure of the heater or its early replacement. Another problem with previous coating materials is their tendency to separate from the sheath when the current flow through the heater produces high watt-densities. This again ultimately allows the chemical environment to attack the heater and cause it to fail or need to be replaced.

Among the several objects of the present invention is to provide a metal sheathed immersion electrical heater for use in a chemically corrosive environment with a coating that is less liable to have or form pinholes than such heaters known heretofore.

Another object is to provide such a heater with a coating capable of withstanding both prolonged exposure to the environment and the operation of the heater at high watt-density levels without losing its coating properties.

Still another object is to provide a method for manufacturing an immersion heater with the protective coating.

Other objects will become apparent to those skilled in the art in the light of the following description and accompanying drawing.

SUMMARY OF THE INVENTION

In accordance with this invention, generally stated, a metal sheathed immersion heater is provided for use in a chemically corrosive environment. The heater comprises an electrically conductive resistive heating element and a metallic sheath covering the element, the sheath being insulated from the element by refractory insulation in a conventional way. A coating applied over the sheath is capable of maintaining its coating properties when the heater is operating in the environment. The coating retains its properties eve when current flow through the heating element produces a watt-density of at least 30 watts per square inch, and the temperature of the environment exceeds the boiling point of water. The coating is fluoropolymer, preferably Ausimont CM-X fluoropolymer powder material. A method of manufacturing an immersion heater is also disclosed, including abrasively cleaning the sheath, applying a primer coating, baking the units with the primer, applying the fluoropolymer to a thickness of five to ten mils, and baking.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
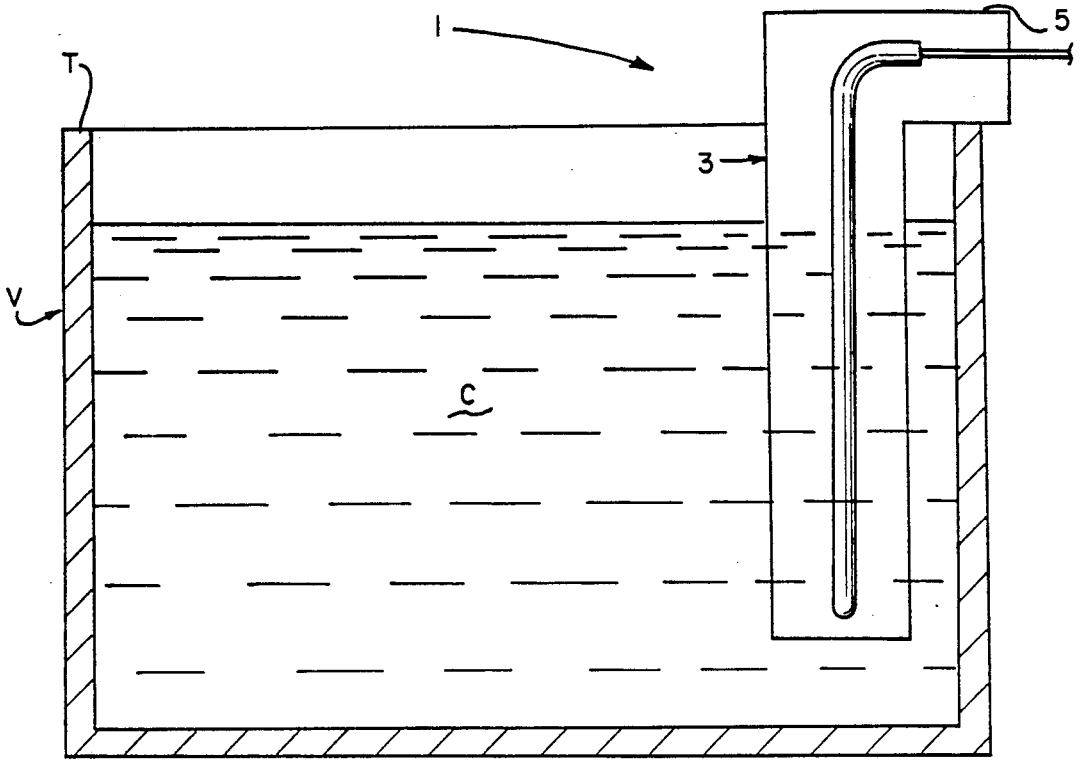
FIG. 1 is a sectional view of a tank containing chemicals in which an over-the-side immersion electric heater has been placed.

Referring to the drawings, reference numeral 1 indicates an illustrative embodiment of immersion heater of the present invention. Heater 1 is an electrical heater which, as shown in FIG. 1, is immersible in a vat V or tank which is filled with a liquid chemical C. The heater is an over-the-side heater; that is, the heater is mounted in a frame 3 having an arm 5 that attaches to the top T of the tank (or hangs over the side thereof). In either event, the heater is suspended in the vat to a depth greater than the level of the chemical C with which the vat is filled. Chemical C may be a corrosive chemical, and as such, may damage the heater over a period of time as it reacts with the heater.

Figure 2:
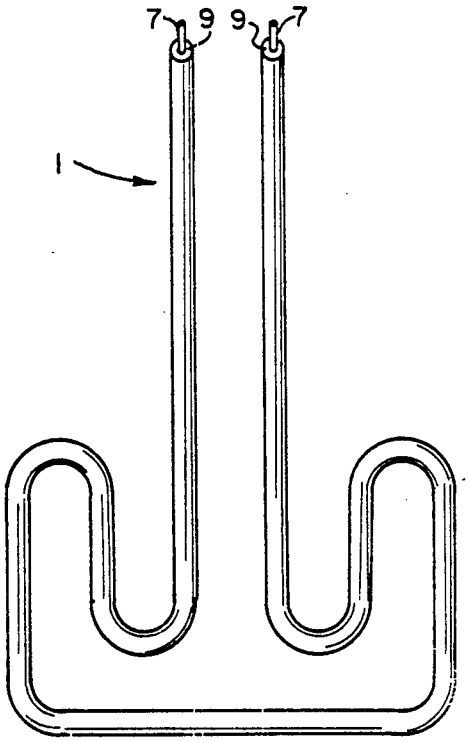
FIG. 2 is an elevational view of the heater.
Figure 3:
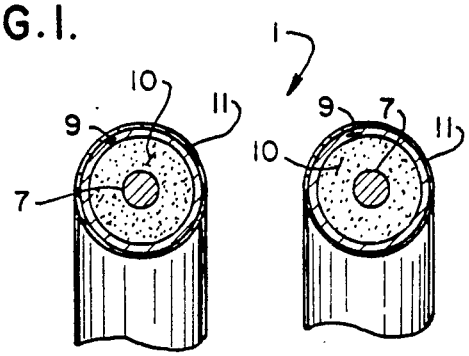
FIG. 3 is a sectional view of the heater.

As shown in FIGS. 2 and 3, heater 1 includes a conventional helical resistance wire element, mechanically and electrically connected at each of its two ends to one or more terminal pins 7. The element is encased in a metallic sheath 9, from which it is insulated by refractory insulation. The outer surface of the sheath is coated with a coating material 11. The shape of the sheathed element may be one of a number of different types, the shape shown in FIG. 2 being exemplary only.

Because of the chemically corrosive environment in which heater 1 operates, it is important for the coating to protect the heating element under the extreme conditions to which it is subjected. In the past, however, problems have arisen with the coating material 11 being used. For example, some coating materials tend to have pin holes form in them. These allow the chemicals in the vat to attack the sheath over the heating element and ultimately eat away the sheath and expose the heating element. This renders heater 1 unusable and it has to be repaired or replaced. Additionally, when a current flows through the heater, the watt-density to which the heater is subjected may cause those coatings to separate from the sheath. This again exposes the sheath to the chemically corrosive environment.

The coating 11 of the present invention is preferably a fluoropolymer powder material, and specifically an Ausimont CM-X fluoropolymer powder material available from Vitek Coating Division, Vitek Research Corp., of Derby, Conn. This material as been found to maintain its coating properties not only when heater 1 is immersed in the corrosive environment created within vat V, but also, when the watt-density of heating element 7 exceeds 30 watts per square inch, and the temperature of the environment exceeds the boiling point of water. The advantage of the fluoropolymer powder material is that it protects the heater even under extreme operating conditions, prolonging its useful life, and reducing repair and maintenance costs.

As a method, the invention comprises coating the metallic sheath of an immersion heater with a fluoropolymer powder material such as an Ausimont CM-X fluoropolymer powder material. In the preferred method, the sheath is cleaned with a grit blast; the terminal pins and a short length, for example, three fourths of an inch, of the sheath immediately adjacent the pins are covered with a plastic cap or the like, and the rest of the sheath is coated with a primer coating, for example Vicoat F4-A 250, also available from Vitek Coating Division, or its equivalent, and baked. While the units are warm, a coating of fluoropolymer is applied to a thickness of at least five mils, and preferably no more than ten mils, and the unit is given a final bake at about 750 degrees Fahrenheit. The unit is then checked for voids or pinholes. If any are found, the unit is rejected, the coating is stripped and the process repeated. The ends of the units are coated with RTV 732 or its equivalent to prevent moisture absorption before the unit is packaged for use.

Having thus described the invention, what is claimed and desired to be secured by Letters Patent is:

1. In an immersion heater for use in a chemically corrosive environment, the heater comprising an electrically conductive heating element and a metallic sheath covering the element, the improvement comprising a protective coating baked onto the sheath and capable of maintaining its protective properties when the heater is operating in the environment, current flow through the heating element produces a watt-density of at least 30 watts per square inch, and the temperature of the environment exceeds the boiling point of water the coating being a fluoropolymer powder material which is 5 to 10 mils thick about the sheath.

2. The improvement of claim 1 wherein the coating is an Ausimont CM-x fluoropolymer powder material.

3. An immersion heater for use in a chemically corrosive environment comprising:

an electrically conductive heating element capable of a watt-density of at least 30 watts per square inch when current flows through the element;

a metallic sheath covering the heating element; and, a protective coating baked onto the sheath to a thickness of between 5 and 10 mils, the coating being a fluoropolymer powder material capable of maintaining its protective properties when the heater is immersed in the environment, the watt-density of the heating element exceeds the aforesaid 30 watts per square inch, and the temperature of the environment exceeds the boiling point of water.

4. A method of producing an immersion heater having a sheathed heating element and terminal pine projecting from ends of said sheathed element, the heater being for use in a chemically corrosive environment having an environmental temperature exceeding the boiling point of water and comprising:

covering an electrically resistive heating element with a metallic sheath, the sheathed element being immersible in the environment and capable of producing a watt-density of at least 30 watts per square inch when current flows therethrough; cleaning the exterior of said sheath; thereafter applying a primer coating to said sheath while maintaining said terminal pins and a short area of said ends of said sheath clean, thereafter applying a protective coating to said primed sheath, and baking said coating at a temperature on the order of 750° F., said coating being applied to a thickness of between 5 and 10 mils, and the coating being a fluoropolymer powder coating material capable of maintaining its protective properties when the heater is immersed in the environment, watt-density of the heating element exceeds the aforesaid 30 watts per square inch, and the temperature of the environment exceeds the boiling point of water.

5. The method of claim 4 wherein the coating is an Ausimont CM-X fluoropolymer powder coating material.

* * * * *